US010330311B2

(12) United States Patent
Park et al.

(10) Patent No.: US 10,330,311 B2
(45) Date of Patent: Jun. 25, 2019

(54) BURNER TO EVENLY DISTRIBUTE FLAME

(71) Applicant: LG ELECTRONICS INC., Seoul (KR)

(72) Inventors: Janghee Park, Seoul (KR); Yongki Jeong, Seoul (KR); Jaebeom Lim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 586 days.

(21) Appl. No.: 14/930,196

(22) Filed: Nov. 2, 2015

(65) Prior Publication Data

US 2016/0178212 A1 Jun. 23, 2016

(30) Foreign Application Priority Data

Dec. 17, 2014 (KR) ..... 10-2014-0182331

(51) Int. Cl.
*F23D 14/06* (2006.01)
*F24C 3/08* (2006.01)

(52) U.S. Cl.
CPC ..... *F23D 14/06* (2013.01); *F24C 3/085* (2013.01)

(58) Field of Classification Search
CPC ..... F23D 14/06; F24C 3/085
See application file for complete search history.

(56) References Cited

U.S. PATENT DOCUMENTS 4,757,801 A * 7/1988 Le Monnier de Gouville ..... F23D 14/06 126/39 H
5,133,658 A * 7/1992 Le Monnier De Gouville ..... F23D 14/06 126/39 R
5,266,026 A * 11/1993 Riehl ..... F23D 14/06 126/39 E
6,135,764 A * 10/2000 Kwiatek ..... F23D 14/06 126/39 E
6,325,619 B2 * 12/2001 Dane ..... F23D 14/065 126/39 E
7,901,205 B2 * 3/2011 Trochou ..... F23D 14/06 126/39 E
8,171,927 B2 * 5/2012 Pryor ..... F23D 14/06 126/39 E (Continued)

FOREIGN PATENT DOCUMENTS

GB 2276716 A * 10/1994 ..... F23D 14/065
WO WO 2013068775 A1 * 5/2013 ..... F23D 14/065

*Primary Examiner* — Kenneth Rinehart
*Assistant Examiner* — Logan P Jones
(74) *Attorney, Agent, or Firm* — Dentons US LLP

(57) ABSTRACT

A burner includes a burner head to receive a mixed gas; and a burner cap to cover the burner head, wherein the burner head includes an outer wall having a plurality of first flame holes through which a flame is discharged, an inner wall located at an inside of the outer wall and having a plurality of second flame holes through which the flame is discharged, and a mixed gas chamber between the outer wall and the inner wall; the burner cap includes a distribution guide to guide a flow of the mixed gas so that the mixed gas flows along a circumferential direction of the mixed gas chamber, and a first portion of the mixed gas flowing along the distribution guide is distributed to the first flame holes, and a second portion of the mixed gas flowing along the distribution guide flows toward the second flame holes.

7 Claims, 6 Drawing Sheets

(56) References Cited

U.S. PATENT DOCUMENTS

| | | | | |
|---|---|---|---|---|
| 2007/0017501 | A1* | 1/2007 | Puabhanich | F23D 14/065 126/39 R |
| 2009/0087804 | A1* | 4/2009 | Pryor | F23D 14/06 431/350 |
| 2009/0320823 | A1* | 12/2009 | Padgett | F23D 14/06 126/39 E |
| 2010/0206293 | A1* | 8/2010 | Padgett | F23D 14/06 126/39 E |
| 2016/0178209 | A1* | 6/2016 | Park | F24C 3/08 126/39 E |

* cited by examiner

BURNER TO EVENLY DISTRIBUTE FLAME

CROSS-REFERENCE TO RELATED APPLICATION(S)

This application claims priority under 35 U.S.C. § 119 to Korean Application No. 10-2014-0182331, filed in Korea on Dec. 17, 2014, which is incorporated by reference in its entirety for all purposes as if fully set forth herein.

BACKGROUND

Field of the Disclosure

A burner is to evenly distribute flame is disclosed herein.

Background

Generally, a burner serves to directly heat food or a container filled with the food using a flame generated when burning a gas.

Efficiency or heating performance of the burner may be enhanced when the flame is uniformly generated from the burner.

Korean Unexamined Patent Application Publication No. 2014-0090773 (published on Jul. 18, 2014) discloses a burner cap and a burner.

In the above-described related document, a distribution protrusion is formed on a lower surface of the burner cap, and a connection guide protrudes from an edge of the distribution protrusion. A mixed gas runs into the distribution protrusion, and a flow speed thereof is primarily reduced, and then secondarily reduced by a distribution guide, and thus the mixed gas is spread in an area formed by the connection guide.

However, in the case of the related document, since the distribution protrusion is provided at only a position corresponding to a mixer tube, and the connection guide protrudes downward from the distribution protrusion, there is a problem in that the mixed gas flowing over the connection guide flows to only flame holes near the connection guide, and is not evenly distributed toward flame holes far from the connection guide. That is, since the connection guide does not serve to guide the mixed gas toward the flame holes far from the connection guide, an intensity of the flame of the flame holes near the connection guide is relatively large.

SUMMARY

The present disclosure is directed to a burner in which a mixed gas is evenly distributed, and thus a flame is uniformly generated.

According to an aspect of the present disclosure, there is provided a burner including a burner head to receive a mixed gas; and a burner cap to cover the burner head, wherein the burner head includes an outer wall having a plurality of first flame holes through which a flame is discharged, an inner wall located at an inside of the outer wall and having a plurality of second flame holes through which the flame is discharged, and a mixed gas chamber between the outer wall and the inner wall, wherein the burner cap comprises a distribution guide to guide a flow of the mixed gas so that the mixed gas flows in a circumferential direction of the mixed gas chamber, and wherein a first portion of the mixed gas flowing along the distribution guide is distributed to the plurality of first flame holes, and a second portion of the mixed gas flowing along the distribution guide flows toward the plurality of second flame holes.

The details of one or more embodiments are set forth in the accompanying drawings and the description below.

Other features will be apparent from the description and drawings, and from the claims.

BRIEF DESCRIPTION OF THE DRAWINGS

Embodiments will be described in detail with reference to the following drawings in which like reference numerals refer to like elements, and wherein.

and

Figure 6:
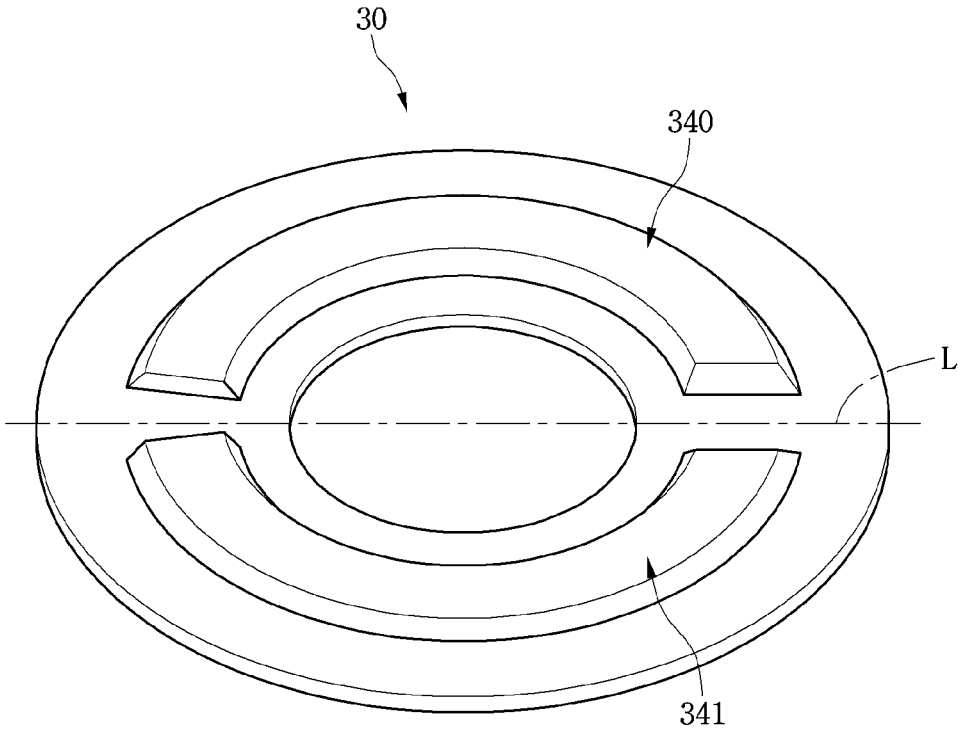

FIG. 6 is a perspective view of a burner cap according to a second embodiment of the present disclosure.

DETAILED DESCRIPTION

Reference will now be made in detail to the embodiments of the present disclosure, examples of which are illustrated in the accompanying drawings.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from scope of the invention. To avoid detail not necessary to enable those skilled in the art to practice the invention, the description may omit certain information known to those skilled in the art. The following detailed description is, therefore, not to be taken in a limiting sense.

Also, in the description of embodiments, terms such as first, second, A, B, (a), (b) or the like may be used herein when describing components of the present invention. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected", "coupled", and "joined" to the latter via another component.

Figure 1:
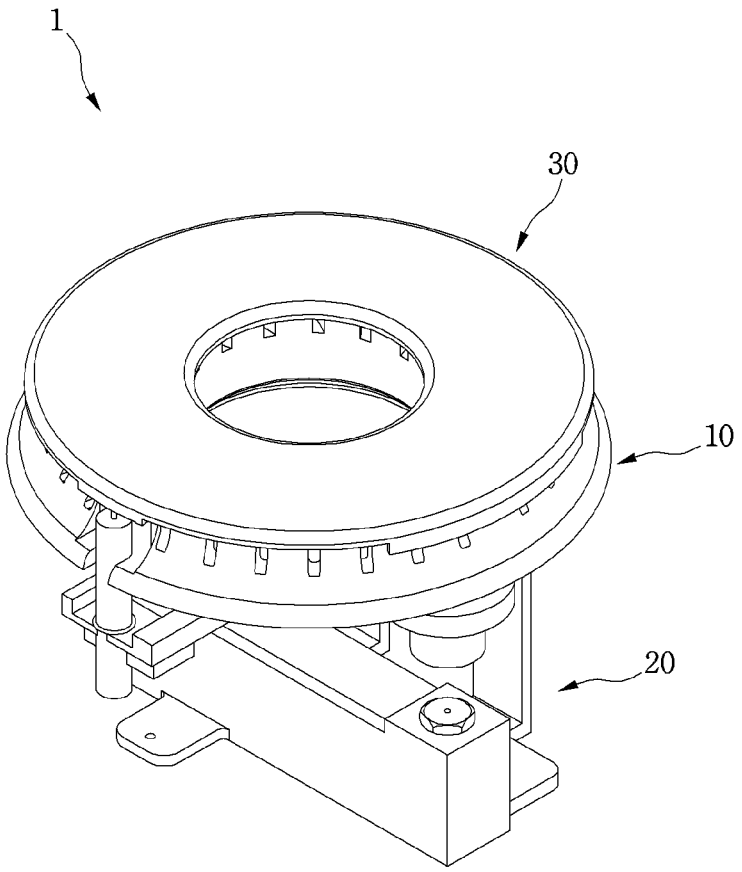
FIG. 1 is a perspective view of a burner according to a first embodiment of the present disclosure.
Figure 2:
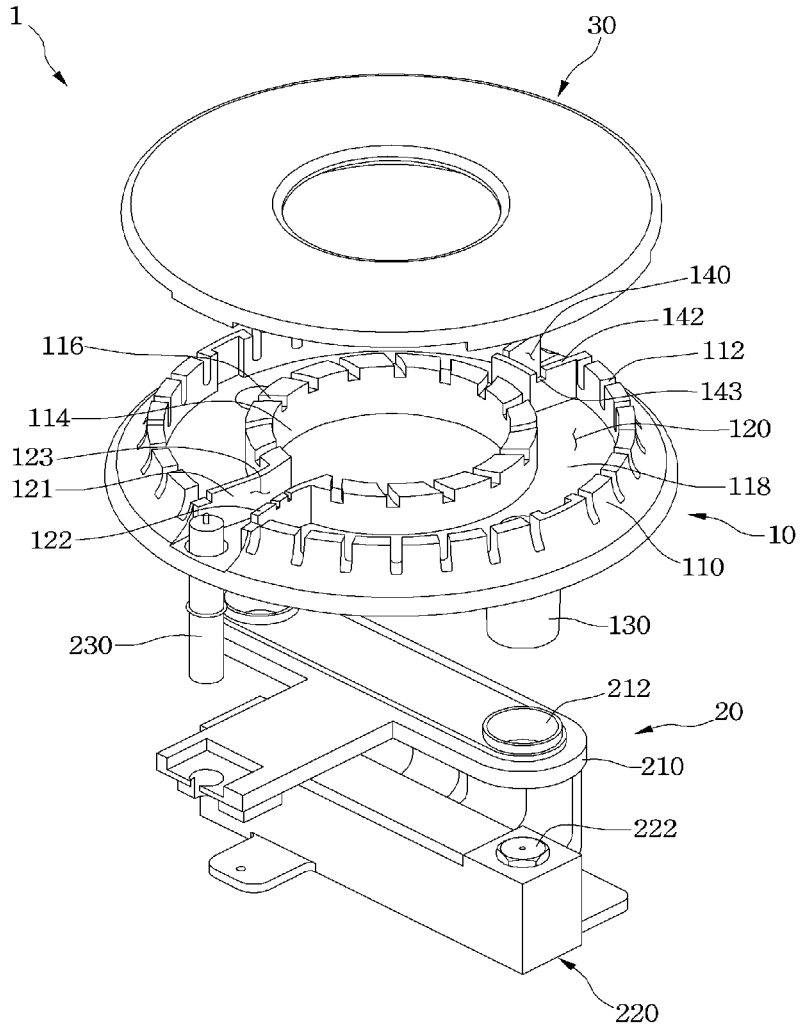
FIG. 2 is an exploded perspective view of the burner of FIG. 1.

FIG. 1 is a perspective view of a burner according to an embodiment, and FIG. 2 is an exploded perspective view of the burner of FIG. 1.

Referring to FIGS. 1 and 2, the burner 1 according to the embodiment may include a burner head 10 having a plurality of flame holes through which a flame is discharged, a burner body 20 which supports the burner head 10, and a burner cap 30 which is seated on an upper side of the burner head 10.

The burner 1 may further include an ignition part 230 which ignites a mixed gas of air and a gas supplied to the burner head 10.

The burner body 20 may include a head support part 210 which supports the burner head 10, and a gas supply part 220 which is connected with the head support part 210.

The head support part 210 may include an opening 212 through which mixed gas supply pipes 130 and 131 (referring to FIG. 4) of the burner head 10 may pass.

The gas supply part 220 may receive the gas and may supply the gas to the burner head 10. The gas supply part 220 may have a plurality of nozzles 222.

Also, the gas supply part 220 may support the ignition part 230.

The burner head 10 according to an embodiment of the present disclosure may include an outer wall 110 (which may be referred to as a "first wall"), and an inner wall 114 (which may be referred to as a "second wall") which is spaced apart from the outer wall 110 toward an inside of the outer wall 110.

The outer wall 110 may include a plurality of first flame holes 112 through which the flame is discharged. The plurality of first flame holes 112 may be disposed to be spaced in a circumferential direction of the outer wall 110.

The inner wall 114 may include a plurality of second flame holes 116 through which the flame is discharged. The plurality of second flame holes 116 may be disposed to be spaced in a circumferential direction of the inner wall 114.

The burner head 10 may further include a bottom wall 118 which forms a mixed gas chamber 120 together with the outer wall 110 and the inner wall 114.

The burner cap 30 may be seated on the outer wall 110 and the inner wall 114. And the burner cap 30 may cover the mixed gas chamber 120. At this time, the burner cap 30 may include an opening 31 so that the flame generated at the inner wall 114 passes through the burner cap 30. For example, the opening 31 may be formed at a center portion of the burner cap 30.

One or more mixed gas supply pipes 130 and 131 (referring to FIG. 4) through which the mixed gas is supplied may be connected to the bottom wall 118. The mixed gas supply pipes 130 and 131 (referring to FIG. 4) may be integrally formed with the bottom wall 118, or may be separately formed from the bottom wall 118 and then may be coupled to the bottom wall 118.

The mixed gas supply pipes 130 and 131 (referring to FIG. 4) may pass through the opening 212 formed at the head support part 210 of the burner body 20. While the burner head 10 is seated on the head support part 210 of the burner body 20, the mixed gas supply pipes 130 and 131 (referring to FIG. 4) are spaced apart from the nozzles 222 provided at the gas supply part 220.

Therefore, when the gas is sprayed from the nozzles 222, air around the mixed gas supply pipes 130 and 131 (referring to FIG. 4) is introduced into the mixed gas supply pipes 130 and 131 together with the gas.

The outer wall 110 and the inner wall 114 may be connected by a plurality of connection walls 121 and 122.

Each of the outer wall 110 and the inner wall 114 may be formed to have an approximately "C" shape when seen from an upper side, and an end of the inner wall 114 and an end of the outer wall 110 may be connected by the plurality of connection walls 121 and 122.

The plurality of connection walls 121 and 122 may include a first connection wall 121 and a second connection wall 122 which is spaced apart from the first connection wall 121.

The first connection wall 121 may connect one end of the outer wall 110 with one end of the inner wall 114. The second connection wall 122 may connect the other end of the outer wall 110 with the other end of the inner wall 114. Therefore, the mixed gas chamber 120 may also have a "C" shape when seen from an upper side.

At least a part of the ignition part 230 may be located between the first connection wall 121 and the second connection wall 122.

A space between the first connection wall 121 and the second connection wall 122 may serve as a flame spread passage through which the flame is spread between the outer wall 110 and the inner wall 114. That is, the burner head 10 may include a flame spread passage 123 located between the first connection wall 121 and the second connection wall 122.

The burner head 10 may further include a flame staying chamber 140 which provides a space configured to cause the flame to be stayed therein.

The flame staying chamber 140 may be formed by recessing a part 142 (hereinafter referred to as a "chamber forming wall") of the outer wall 110 toward the inner wall 114. One or more slits 143 may be formed at the chamber forming wall 142.

According to the flame staying chamber 140, the flame may be stayed in the flame staying chamber 140, even though the flame of the outer wall 110 and the inner wall 114 is extinguished in the process of using the burner 1, and thus the mixed gas may be reignited at the outer wall 110 and the inner wall 114 by the flame in the flame staying chamber 140, thereby generating the flame.

In particular, when the burner 1 is used while being installed at a gas oven range, or the gas oven range is used in a built-in state, the flame of the inner wall 114 and the outer wall 110 of the burner 1 may be extinguished in the process of opening and closing an oven door of the gas oven range. Even in this case, the mixed gas may be reignited at the outer wall 110 and the inner wall 114 by the flame in the flame staying chamber 140, and thus the flame may be generated.

Figure 3:
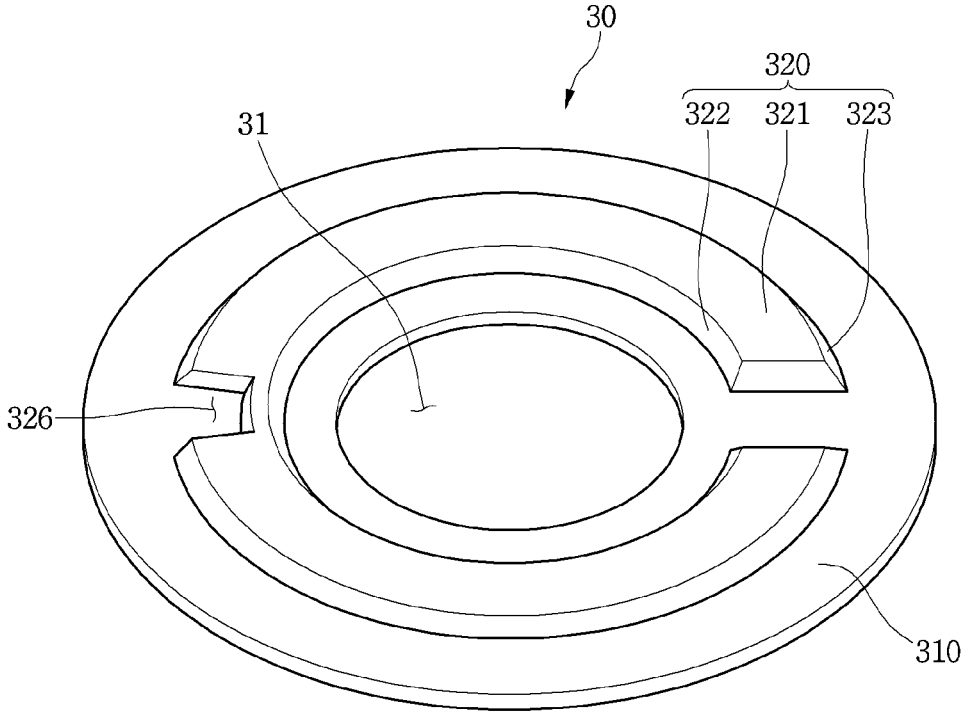
FIG. 3 is a perspective view of a burner cap according to the a first embodiment of the present disclosure.
Figure 4:
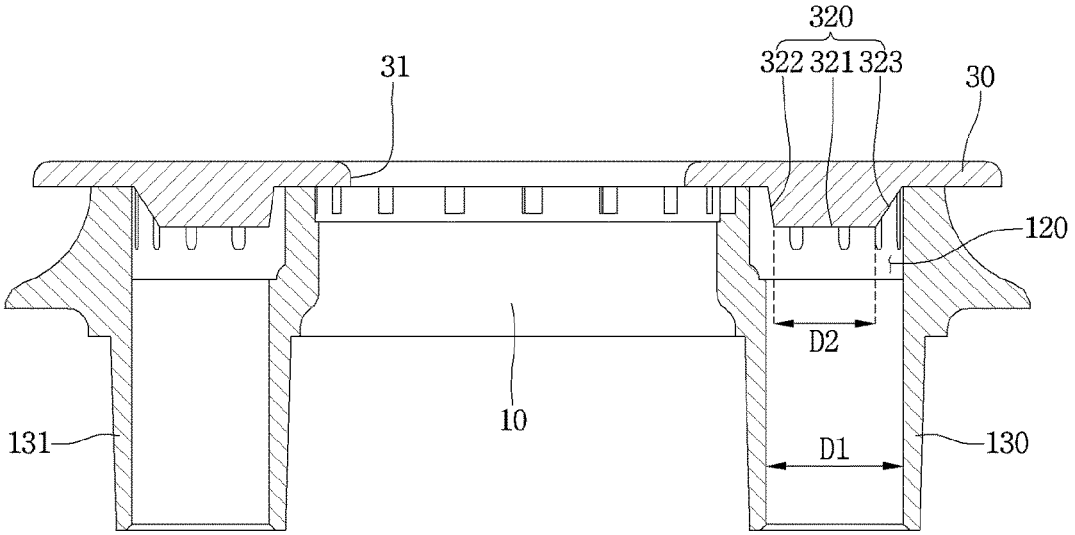
FIG. 4 is a cross-sectional view of the burner according to a first embodiment of the present disclosure.

FIG. 3 is a perspective view of the burner cap 30 according to the first embodiment, and FIG. 4 is a cross-sectional view of the burner 1 according to the first embodiment.

In FIG. 3, a lower structure of the burner cap 30 is illustrated as an example.

Referring to FIGS. 2 to 4, the burner cap 30 according to the first embodiment may include a cap body 310 having an opening 31 formed at a center portion thereof. The flame generated in the second flame holes 116 of the inner wall 114 may pass through the opening 31.

The burner cap 30 may further include a distribution guide 320 which protrudes downward from the cap body 310 so that the mixed gas introduced into the mixed gas chamber 120 within the burner head 10 is evenly distributed into the mixed gas chamber 120.

The distribution guide 320 may be rounded, and both ends thereof may be spaced in the horizontal direction. For example, the distribution guide 320 may have a "C" shape when seen from an upper side. A circumferential length of the distribution guide 320 is longer than a horizontal distance between the spaced both ends.

While the burner cap 30 is seated on the burner head 10, the distribution guide 320 may be accommodated in the mixed gas chamber 120.

In order to be accommodated the distribution guide 320 in the mixed gas chamber 120, the inner diameter of the distribution guide 320 is greater than the diameter of the opening 31 and the outer diameter of the inner wall 114, the outer diameter of the distribution guide 320 may be smaller than the outer diameter of the outer wall 110.

The both ends of the distribution guide 320 are spaced apart from each other for preventing interference with the first connection walls 121 and the second connection wall 122 while the burner cap 30 is seated on the burner head 10. That is, the both ends of the distribution guide 320 are spaced and the flame spread passage 123 may be located between the both ends of the distribution guide 320.

The distribution guide 320 may be spaced from the outer wall 110 and the inner wall 114. The distribution guide 320 may include a guide lower surface 321 which has a predetermined width, and a first guide surface 322 and a second surface 323 which connect the guide lower surface 321 with the lower surface of the cap body 310.

The first guide surface 322 is an inner circumferential surface of the distribution guide 320 and is disposed closer to the inner wall 114 than the outer wall 110. That is, the first guide surface 322 is a surface facing the inner wall 114.

The second guide surface 323 is an outer circumferential surface of the distribution guide 320 and is disposed closer to the outer wall 110 than the inner wall 114. That is, the second guide surface 323 is a surface facing the outer wall 110.

The distribution guide 320 has a "C" shape when seen from an upper side. Therefore, the guide lower surface 321, each of the first guide surface 322 and the second guide surface 323 may also have a "C" shape when seen from an upper side.

That is, while the first guide surface 322 is spaced apart from the inner wall 114, may be roundly disposed along the circumference of the inner wall 114, and while the second guide surface 323 is spaced apart from the outer wall 110, may be roundly disposed along the circumference of the outer wall 110.

Each of the guide surfaces 322 and 323 serves to guide the mixed gas introduced into the mixed gas chamber 120 to flow along each of the guide surfaces 322 and 323 and then to be evenly distributed in the mixed gas chamber 120.

Each of the first guide surface 322 and the second guide surface 323 may be disposed to be inclined at a predetermined angle with respect to the vertical line.

At this time, an inclination angle of the first guide surface 322 may be the same or different from an inclination angle of the second guide surface 323.

In FIG. 3, for example, an inclination angle of the second guide surface 323 is illustrated to be larger than an inclination angle of the first guide surface 322 with respect to the vertical line.

Each of the guide surfaces 322 and 323 is inclined at a predetermined angle with respect to the vertical line to smoothly flow the mixed gas toward the first guide surface 322 and the second guide surface 323 while the mixed gas introduced into the mixed gas chamber 120 contacts with the guide lower surface 321.

The guide lower surface 321 may be disposed to be longitudinally overlapped with a plurality of mixed gas supply pipes 130 and 131.

At this time, a width D2 of the guide lower surface 321 may be smaller than an inner diameter D1 of the mixed gas supply pipes 130 and 131. A width D2 of the guide lower surface 321 may be greater than a radius of the mixed gas supply pipes 130 and 131.

Also, at least a part of the first guide surface 322 may be disposed to be longitudinally overlapped with the plurality of mixed gas supply pipes 130 and 131. At least a part of the second guide surface 323 may be disposed to be longitudinally overlapped with the plurality of mixed gas supply pipes 130 and 131.

That is, based on a vertical section of the burner 1, the entire area of a right and left direction of the guide lower surface 321 may be longitudinally overlapped with the mixed gas supply pipes 130 and 131.

Therefore, a portion of the mixed gas introduced into the mixed gas chamber 120 through the mixed gas supply pipes 130 and 131 contacts with the guide lower surface 321 of the distribution guide 320, and then is changed a direction, another portion of the mixed gas introduced into the mixed gas chamber 120 may be in direct contact with the first guide surface 322 and the second guide surface 323.

While the burner cap 30 is seated on the burner head 10, the distribution guide 320 may include a groove 326 for preventing interference with the chamber forming wall 142 forming the flame staying space.

Hereinafter, a distributing process of the mixed gas by the distribution guide 320 will be described.

Figure 5:
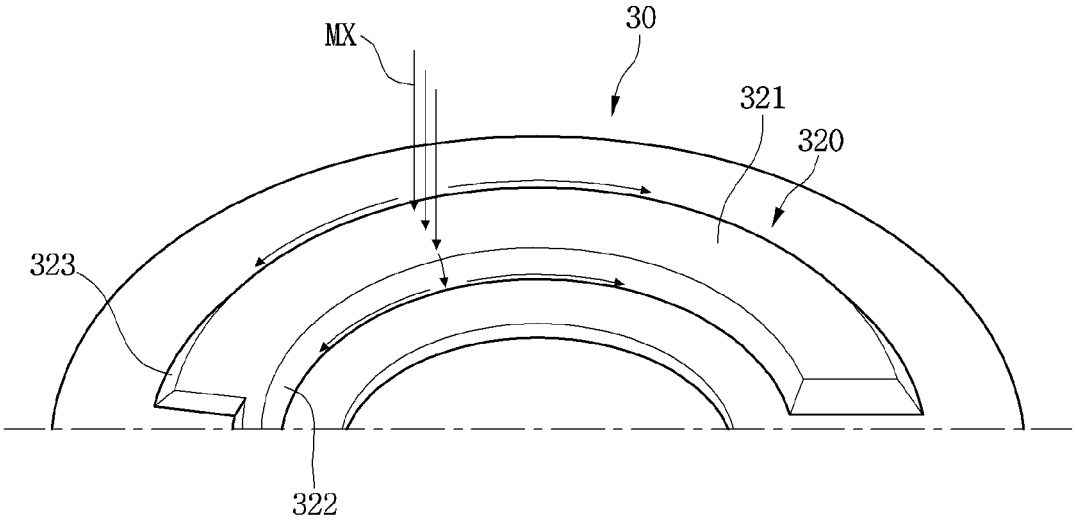
FIG. 5 is a view illustrating a mixed gas flowing along the distribution guide of a burner cap.

FIG. 5 is a view illustrating a mixed gas flowing along the distribution guide 320 of the burner cap 30.

Referring to FIGS. 4 to 5, a portion of the mixed gas MX introduced into the mixed gas chamber 120 through the plurality of mixed gas supply pipes 130 and 131 is collided with the guide lower surface 321 of the distribution guide 320. The mixed gas MX collided with the guide lower surface 321 of the distribution guide 320 is changed a direction, and then rises along the first guide surface 322 and the second guide surface 323.

A flow of the mixed gas MX rising along each of the guide surfaces 322 and 323 may have two flow patterns.

In a first flow pattern, the mixed gas MX contacts with the guide lower surface 321 of the distribution guide 320, and then is changed a direction and flows toward the inner wall 114 or the outer wall 110 in a radial direction along the guide lower surface 321 of the distribution guide 320.

In a second flow pattern, the mixed gas MX flows along the first guide surface 322 and the second guide surface 323 in the circumferential direction of the distribution guide 320.

Among the two flow patterns, a flow resistance of the mixed gas MX in the second flow pattern is smaller than a flow resistance of the mixed gas MX in the first flow pattern.

Therefore, while the mixed gas MX divided by the distribution guide 320, as described in the second flow pattern, the mixed gas MX colliding with the guide lower surface 321 flows along the first guide surface 322 and the second guide surface 323 in the circumferential direction of the distribution guide 320.

That is, each of the guide surfaces 322 and 323 guides a flow of the mixed gas MX to flow in the circumferential direction of the mixed gas chamber 120. And a portion of a mixed gas flowing in the circumferential direction, that is, a mixed gas flowing along the first guide surface 322 is distributed to the plurality of second flame holes 116.

Another portion of the mixed gas flowing in the circumferential direction, that is, a mixed gas flowing along the second guide surface 323 is distributed to the plurality of first flame holes 112.

Therefore, as the mixed gas introduced into the mixed gas chamber 120 flows along each of the guide surfaces 322 and 323 of the distribution guide 320, the mixed gas may be evenly distributed into the mixed gas chamber 120, and thus a flame generated at the plurality of first flame holes 112 of the outer wall 110 may be generally uniform, and also a flame generated at the plurality of second flame holes 116 of the inner wall 114 may be generally uniform.

FIG. 6 is a perspective view of the burner cap 30 according to the second embodiment of the present disclosure.

The embodiment has a difference in a shape of a distribution guide, but is the same as the first embodiment in other element. Therefore, hereinafter, only a specific element of the embodiment will be described below.

Referring to FIG. 6, the burner cap 30 according to the second embodiment may include a plurality of distribution guides 340 and 341.

The plurality of distribution guides 340 and 341 may include a first distribution guide 340 and a second distribution guide 341.

Each of the first distribution guide 340 and the second distribution guide 341 includes a guide lower surface described at the first embodiment, and a first guide surface and a second guide surface. And, a lower surface of the first distribution guide 340 may be longitudinally overlapped with one of a plurality of mixed gas supply pipes, a lower surface of the second distribution guide 341 may be longitudinally overlapped with another of a plurality of mixed gas supply pipes The first distribution guide 340 and the second distribution guide 341 may be disposed to be spaced a predetermined distance.

In order to enhance distribution performance of a mixed gas by each of the distribution guides 340 and 341, a circumferential length of each of the first distribution guide 340 and the second distribution guide 341 is longer than a horizontal distance between the ends of the first distribution guide 340 and the ends of the second distribution guide 341.

The chamber forming wall 142 and the connection walls 121 and 122 described in FIG. 2 may be located in a distance between the first distribution guide 340 and the second distribution guide 341.

Based on an imaginary line bisecting the burner cap 30 and passing the distance between the first distribution guide 340 and the second distribution guide 341, each of the distribution guides 340 and 341 may be formed to be convexly rounded in the direction away from the imaginary line L.

According to the embodiment, the mixed gas introduced into the mixed gas chamber 120 may be evenly distributed into the mixed gas chamber 120 by the plurality of distribution guides.

Even though all the elements of the embodiments are coupled into one or operated in the combined state, the present disclosure is not limited to such an embodiment. That is, all the elements may be selectively combined with each other without departing the scope of the invention. Furthermore, when it is described that one comprises (or comprises or has) some elements, it should be understood that it may comprise (or include or have) only those elements, or it may comprise (or include or have) other elements as well as those elements if there is no specific limitation. Unless otherwise specifically defined herein, all terms comprising technical or scientific terms are to be given meanings understood by those skilled in the art. Like terms defined in dictionaries, generally used terms needs to be construed as meaning used in technical contexts and are not construed as ideal or excessively formal meanings unless otherwise clearly defined herein.

Although embodiments have been described with reference to a number of illustrative embodiments thereof, it will be understood by those skilled in the art that various changes in form and details may be made therein without departing from the scope of the invention as defined by the appended claims. Therefore, the preferred embodiments should be considered in descriptive sense only and not for purposes of limitation, and also the technical scope of the invention is not limited to the embodiments. Furthermore, is defined not by the detailed description of the invention but by the appended claims, and all differences within the scope will be construed as being comprised in the present disclosure.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A burner comprising:

a burner head to receive a mixed gas; and a burner cap to cover the burner head, wherein the burner head comprises an outer wall having a plurality of first flame holes through which a flame is discharged, an inner wall located at an inside of the outer wall and having a plurality of second flame holes through which the flame is discharged, a mixed gas chamber between the outer wall and the inner wall, and a chamber forming wall which forms a flame staying chamber for containing the flame;

wherein the burner cap comprises a distribution guide to guide a flow of the mixed gas so that the mixed gas in the mixed gas chamber flows in a circumferential direction of the mixed gas chamber, and wherein a first portion of the mixed gas flowing along the distribution guide is distributed to the plurality of first flame holes, and a second portion of the mixed gas flowing along the distribution guide flows toward the plurality of second flame holes, wherein the distribution guide protrudes downward from a lower surface of the burner cap, and includes a guide lower surface, a first guide surface to form an inner periphery of the distribution guide, and a second guide surface to form an outer periphery of the distribution guide, wherein the distribution guide includes a groove for preventing interference with the chamber forming wall, wherein the groove is recessed from the second guide surface toward the first guide surface, and wherein when the burner cap is seated on the burner head, the chamber forming wall is located in the groove.

2. The burner according to claim 1, wherein each of the first guide surface and the second guide surface is inclined at a predetermined angle with respect to a vertical line perpendicular to the lower surface of the burner cap.

3. The burner according to claim 1, wherein the burner head further comprises a mixed gas supply pipe to supply the mixed gas to the mixed gas chamber, and wherein a width of the guide lower surface is smaller than an inner diameter of the mixed gas supply pipe.

4. The burner according to claim 3, wherein a part of the guide lower surface, and a part of each of the first and the second guide surfaces are longitudinally overlapped with the mixed gas supply pipe.

5. The burner according to claim 1, wherein the burner head further comprises a plurality of mixed gas supply pipes to supply the mixed gas to the mixed gas chamber, and wherein the guide lower surface is longitudinally overlapped with each of the plurality of mixed gas supply pipes.

6. The burner according to claim 1, wherein the distribution guide is curved, and includes a first end and a second end spaced apart from each other, and wherein a circumferential length of the distribution guide is longer than a horizontal distance between the first and the second ends of the distribution guide.

7. The burner according to claim 6, wherein the burner head further comprises a flame spread passage to spread the flame, and wherein the flame spread passage is between the first and the second ends of the distribution guide.

* * * * *